US010626709B2

(12) United States Patent
Al-Dossary

(10) Patent No.: US 10,626,709 B2
(45) Date of Patent: Apr. 21, 2020

(54) STEAM DRIVEN SUBMERSIBLE PUMP

(71) Applicant: Saudi Arabian Oil Company, Dhahran (SA)

(72) Inventor: Faisal M. Al-Dossary, Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 230 days.

(21) Appl. No.: 15/617,225

(22) Filed: Jun. 8, 2017

(65) Prior Publication Data

US 2018/0355703 A1 Dec. 13, 2018

(51) Int. Cl.

| | |
|---|---|
| ***E21B 43/12*** | (2006.01) |
| ***F01D 15/10*** | (2006.01) |
| ***F01K 7/16*** | (2006.01) |
| ***E21B 41/00*** | (2006.01) |
| ***F04D 13/10*** | (2006.01) |
| ***F04D 13/04*** | (2006.01) |

(52) U.S. Cl.

CPC ..... *E21B 43/128* (2013.01); *E21B 41/0085* (2013.01); *E21B 43/129* (2013.01); *F01D 15/10* (2013.01); *F01K 7/165* (2013.01); *F04D 13/04* (2013.01); *F04D 13/10* (2013.01)

(58) Field of Classification Search

CPC .. E21B 43/128; E21B 43/129; E21B 41/0085; E21B 36/006; E21B 43/121; E21B 43/24; F04D 13/10; F04D 13/04; F01K 7/165; F01K 7/38; F01K 25/00; F01D 15/10

See application file for complete search history.

(56) References Cited

U.S. PATENT DOCUMENTS 4,342,197 A * 8/1982 Matthews ..... F03G 7/04 60/641.2
4,388,807 A 6/1983 Matthews
4,407,126 A 10/1983 Aplenc
4,421,163 A 12/1983 Tuttle (Continued)

FOREIGN PATENT DOCUMENTS

WO 03046336 A1 6/2003

OTHER PUBLICATIONS

"Geothermal Power Generation." Bulletin FPD-20(E/A4), www.flowserve.com, Jan. 2011.

(Continued)

*Primary Examiner* — David J Bagnell
*Assistant Examiner* — Jonathan Malikasim
(74) *Attorney, Agent, or Firm* — Bracewell LLP; Constance G. Rhebergen; Linda L. Morgan

(57) ABSTRACT

Methods and systems for lifting wellbore fluids in a subterranean well towards a surface include providing a closed water system free of fluid communication with the wellbore fluids, the closed water system having a water storage tank located outside of a high temperature zone of the subterranean well. Water from the water storage tank is circulated into the high temperature zone of the subterranean well to form a steam. A downhole steam turbine is rotated by the steam to drive a submersible pump system in fluid communication with the wellbore fluids and the wellbore fluids are lifted towards the surface with the submersible pump system. The steam exiting from the steam turbine is directed towards the water storage tank.

14 Claims, 3 Drawing Sheets

(56) References Cited

U.S. PATENT DOCUMENTS

| | | | | |
|---|---|---|---|---|
| 4,682,471 | A * | 7/1987 | Wagner | F01K 21/047 166/303 |
| 5,860,795 | A | 1/1999 | Ridley et al. | |
| 7,849,690 | B1 | 12/2010 | Lakic | |
| 7,854,260 | B2 | 12/2010 | Gaudette et al. | |
| 8,297,355 | B2 | 10/2012 | Hamilton et al. | |
| 8,418,465 | B2 | 4/2013 | Munson, Jr. | |
| 8,512,009 | B2 | 8/2013 | Wonitoy | |
| 8,610,303 | B2 | 12/2013 | Yocum, Jr. | |
| 8,708,046 | B2 | 4/2014 | Montgomery et al. | |
| 8,713,940 | B2 * | 5/2014 | Lakic | H02K 7/1823 60/641.2 |
| 9,874,077 | B2 * | 1/2018 | Petty | E21B 36/001 |
| 2011/0171049 | A1 | 7/2011 | Wonitoy | |
| 2015/0101794 | A1 * | 4/2015 | Canas | E21B 43/38 166/107 |
| 2015/0121868 | A1 | 5/2015 | Fryrear et al. | |
| 2015/0361833 | A1 | 12/2015 | Hinders et al. | |
| 2016/0334141 | A1 | 11/2016 | Shifferaw | |
| 2017/0028316 | A1 * | 2/2017 | Bolin | B01D 19/0057 |

OTHER PUBLICATIONS

Drader et al., "Improved Power Production Efficiency of Hydrothermal Reservoirs Using Downhole Pumps", Thirty-Seventh Workshop on Geothermal Reservoir Engineering, Stanford University, Jan. 30-Feb. 1, 2012.

The International Search Report and Written Opinion for related PCT application PCT/US2018/036636 dated Sep. 11, 2018.

* cited by examiner

STEAM DRIVEN SUBMERSIBLE PUMP

BACKGROUND

1. Field of the Disclosure

The present disclosure relates in general to submersible pump systems for lifting fluids in a subterranean well, and more particularly to using steam to drive such submersible pump systems.

2. Description of the Related Art

A current method of producing hydrocarbon fluid from a subterranean well that lacks sufficient internal pressure for natural production is to utilize an artificial lift method such as an electrical submersible pump (ESP). The ESP can impart a higher pressure to the production fluid to lift the fluid column in the wellbore so that the wellbore fluid rises towards the surface. An ESP can be useful, for example, in high gas/oil ratio operations and in aged fields where there is a loss of energy and the hydrocarbons can no longer reach the surface naturally.

The cause of failure of current ESPs is commonly due to short circuits of the ESP system or failure in the power cables that extend from the surface to the ESP motor to drive the pump. In addition, the operation of ESPs can be costly because they require an external electric power source for continuous operation.

SUMMARY OF THE DISCLOSURE

Embodiments of this disclosure provide systems and methods for improving the reliability and reducing the operating costs of lifting wellbore fluids to the surface. High temperatures within the wellbore are used to produce gas from a closed fluid system with the gas in turn being used to drive a submersible pump system. The high temperatures can be generated by the heat of the motor of the submersible pump system or can be the result of geothermal energy. In embodiments where excess electrical power is generated by the systems or methods, the excess electrical power can be delivered to a power receiver outside of the subterranean well.

In an embodiment of this disclosure a method of lifting wellbore fluids in a subterranean well towards a surface includes providing a closed water system free of fluid communication with the wellbore fluids, the closed water system having a water storage tank located outside of a high temperature zone of the subterranean well. Water from the water storage tank is circulated into the high temperature zone of the subterranean well to form a steam. A downhole steam turbine is rotated with the steam to drive a submersible pump system that is in fluid communication with the wellbore fluids and the wellbore fluids are lifted towards the surface with the submersible pump system. The steam exiting from the steam turbine is directed towards the water storage tank.

In alternate embodiments, the water storage tank can be located within the subterranean well. The closed water system can be located entirely within the subterranean well. The high temperature zone can be heated with geothermal energy or alternately by the submersible pump system.

In other alternate embodiments, the steam turbine can transfer mechanical rotation of the steam turbine to a shaft of the submersible pump system. A gear assembly can be located between the steam turbine and the submersible pump system so that the rate of rotation of the shaft of the submersible pump system can be varied relative to the rate of rotation of the steam turbine.

In yet other alternate embodiments, the steam turbine can drive an electric generator to power the submersible pump system. A power assembly can be located between the steam turbine and the submersible pump system, the power assembly receiving power by way of an electrical cable for initiating operation of the submersible pump system. The power assembly can alternately operate as the electric generator to power the submersible pump system.

In an alternate embodiment of this disclosure, a method of lifting wellbore fluids in a subterranean well towards a surface includes lowering a submersible pump system into the subterranean well as part of a well completion. A closed fluid is circulated through a closed fluid system that is free of communication with the wellbore fluids. The closed fluid is a liquid within a fluid storage tank located outside of a high temperature zone of the subterranean well. The closed fluid is heated to a gas within the high temperature zone of the subterranean well. The gas is used to rotate a turbine that drives the submersible pump system to lift the wellbore fluids towards the surface. The closed fluid returns to the fluid storage tank.

In alternate embodiments, the flow of the gas into the turbine can be controlled with temperature control valves. Circulating the closed fluid can include circulating the closed fluid through the closed fluid system entirely within the subterranean well. Excess electrical power generated by the turbine can be delivered to a power receiver outside of the subterranean well. The closed fluid can return to the fluid storage tank as a liquid, the closed fluid cooling as the closed fluid exits the high temperature zone of the subterranean well.

In another alternate embodiment, a system for lifting wellbore fluids in a subterranean well towards a surface includes a closed water system that is free of fluid communication with the wellbore fluids, the closed water system having a water storage tank located outside of a high temperature zone of the subterranean well. A circulating system extends from the water storage tank into the high temperature zone of the subterranean well, the circulating system operable to absorb sufficient heat from the high temperature zone to convert water of the closed water system to steam. A downhole steam turbine is rotatable by the steam to drive a submersible pump system in fluid communication with the wellbore fluids and lift the wellbore fluids towards the surface with the submersible pump system. The circulating system extends from the steam turbine towards the water storage tank.

In alternate embodiments, the closed water system can be located entirely within the subterranean well. The steam turbine can be operable to transfer mechanical rotation of the steam turbine to a shaft of the submersible pump system.

In other alternate embodiments, a gear assembly can be located between the steam turbine and the submersible pump system, the gear assembly operable to vary the rate of rotation of the shaft of the submersible pump system relative to the rate of rotation of the steam turbine. Alternately, the system can include an electric generator operable to be driven by the steam turbine and power the submersible pump system. A power assembly can be located between the steam turbine and the submersible pump system, the power assembly operable to receive power by way of an electrical cable for initiating operation of the submersible pump system and alternately operable as the electric generator to power the submersible pump system.

BRIEF DESCRIPTION OF THE DRAWINGS

So that the manner in which the above-recited features, aspects and advantages of the disclosure, as well as others that will become apparent, are attained and can be understood in detail, a more particular description of the embodiments of the disclosure briefly summarized above may be had by reference to the embodiments thereof that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION

The Specification, which includes the Summary of Disclosure, Brief Description of the Drawings and the Detailed Description, and the appended Claims refer to particular features (including process or method steps) of the disclosure. Those of skill in the art understand that the disclosure includes all possible combinations and uses of particular features described in the Specification. Those of skill in the art understand that the disclosure is not limited to or by the description of embodiments given in the Specification.

Those of skill in the art also understand that the terminology used for describing particular embodiments does not limit the scope or breadth of the disclosure. In interpreting the Specification and appended Claims, all terms should be interpreted in the broadest possible manner consistent with the context of each term. All technical and scientific terms used in the Specification and appended Claims have the meaning commonly understood by one of ordinary skill in the art to which this disclosure relates unless defined otherwise.

As used in the Specification and appended Claims, the singular forms "a", "an", and "the" include plural references unless the context clearly indicates otherwise. As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Spatial terms describe the relative position of an object or a group of objects relative to another object or group of objects. The spatial relationships apply along vertical and horizontal axes. Orientation and relational words including "uphole" and "downhole"; "above" and "below" and other like terms are for descriptive convenience and are not limiting unless otherwise indicated.

Where the Specification or the appended Claims provide a range of values, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the Specification and appended Claims to a method comprising two or more defined steps, the defined steps can be carried out in any order or simultaneously except where the context excludes that possibility.

Figure 1:
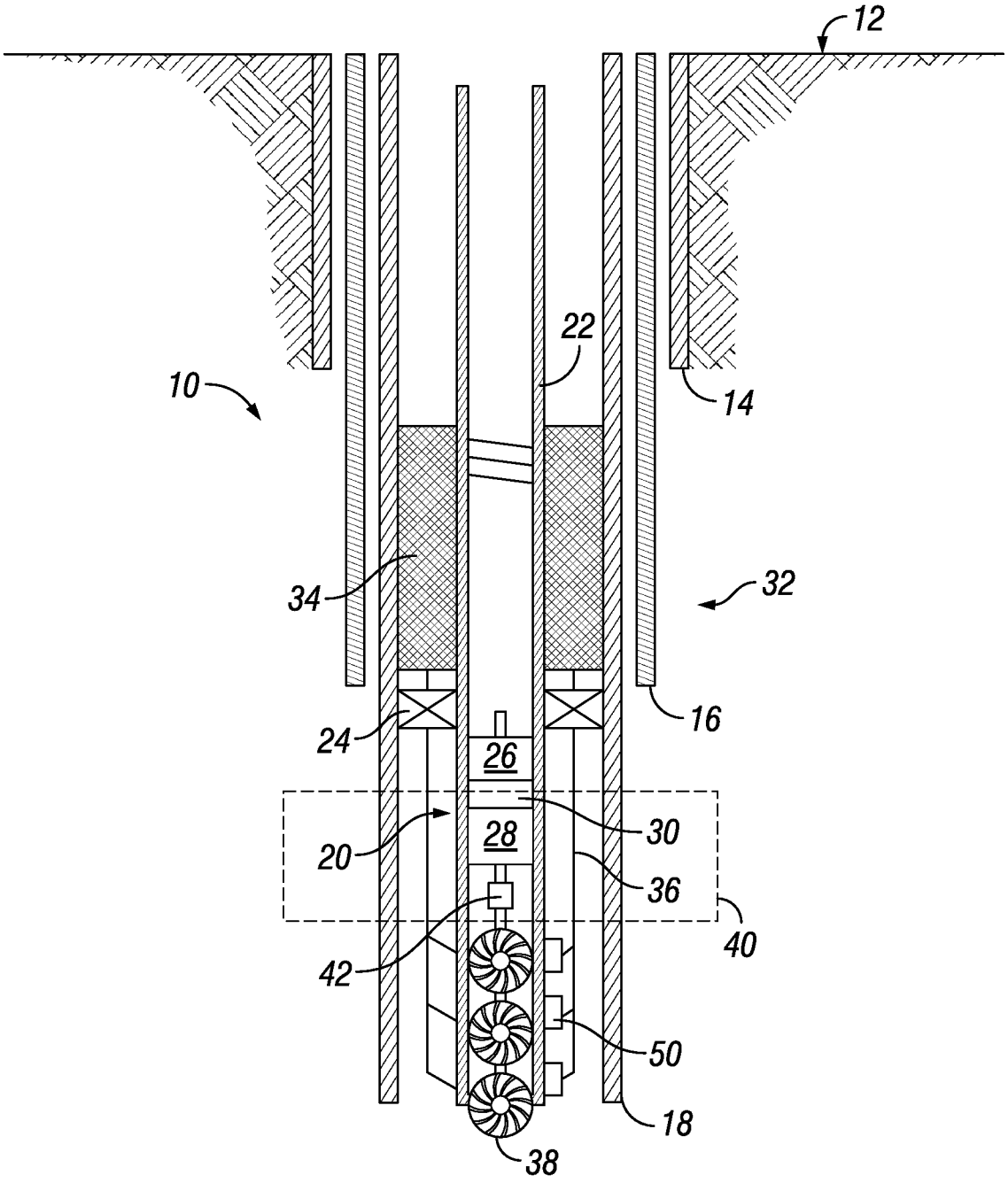
FIG. 1 is a schematic section view of a system for lifting wellbore fluids in a subterranean well with a steam driven submersible pump, in accordance with an embodiment of this disclosure.
Figure 2:
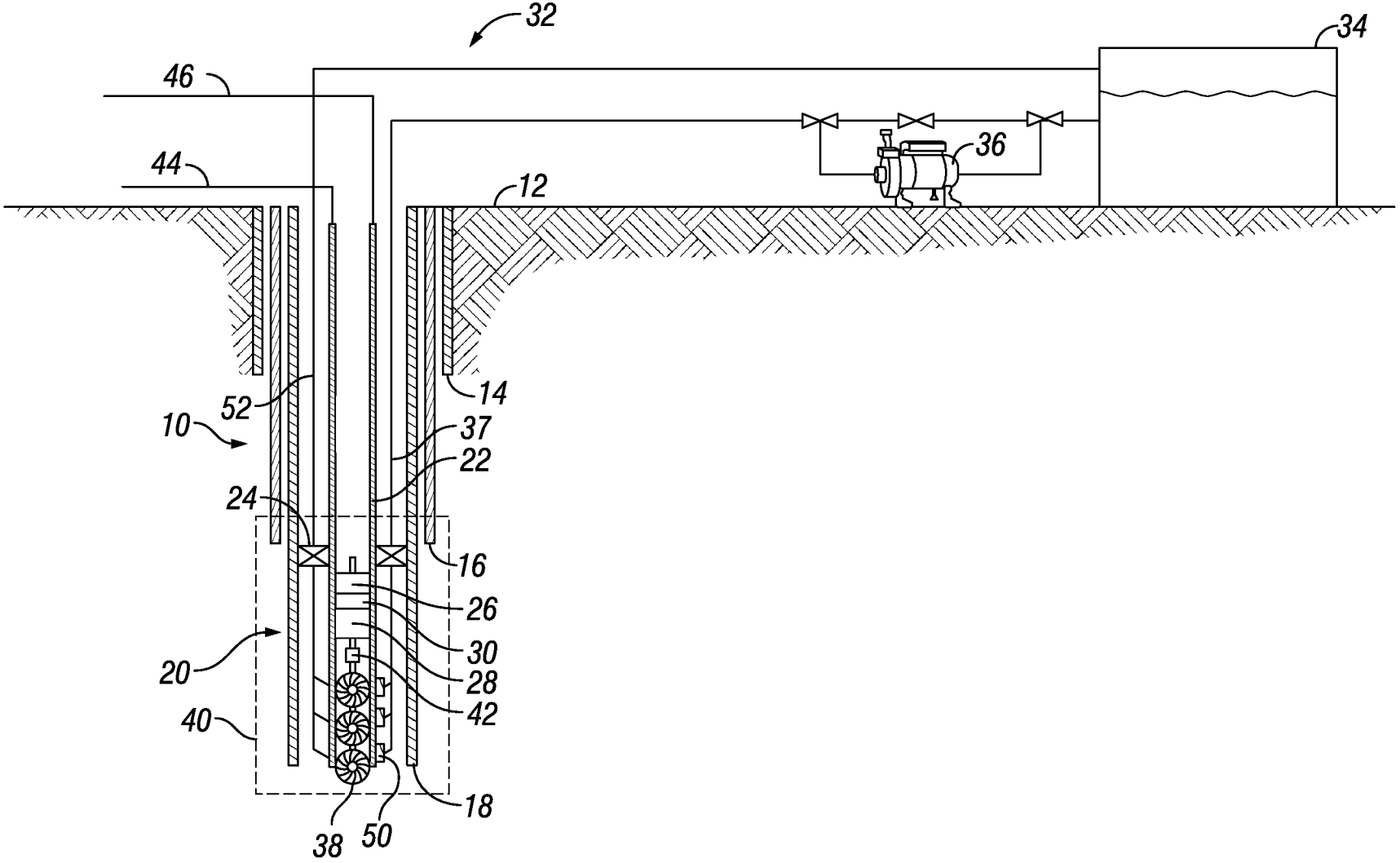
FIG. 2 is a schematic section view of a system for lifting wellbore fluids in a subterranean well with a steam driven submersible pump, in accordance with an alternate embodiment of this disclosure.
Figure 3:
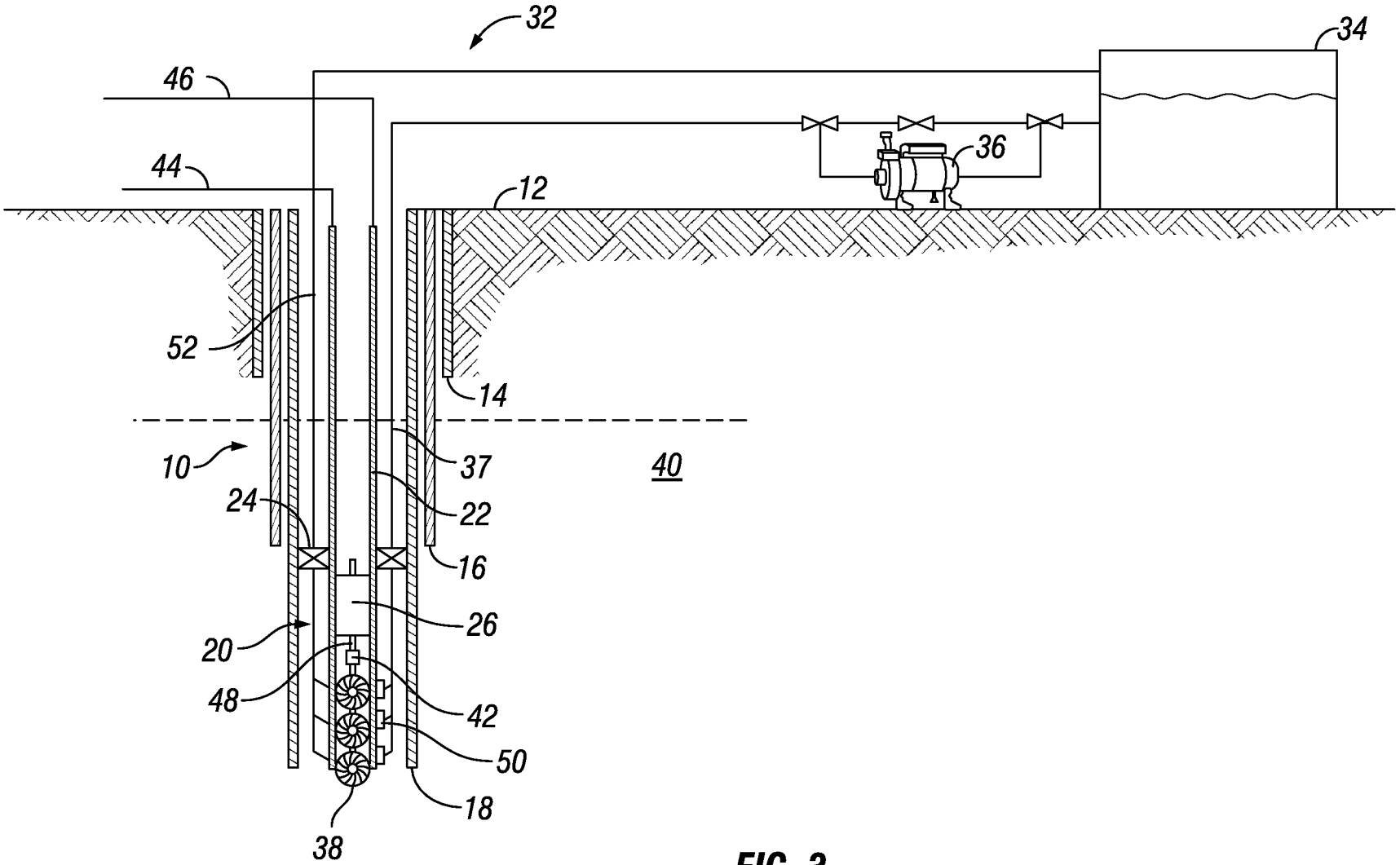
FIG. 3 is a schematic section view of a system for lifting wellbore fluids in a subterranean well with a steam driven submersible pump, in accordance with an alternate embodiment of this disclosure.

Looking at FIGS. 1-3, subterranean well 10 extends from surface 12 and can be used, for example, for or in association with, hydrocarbon development activities. Subterranean well can be completed in a manner known to those in the art using traditional well completion methods. As used herein, the term "well completion" refers to the process of making a subterranean well ready for production or injection and can include, for example, the installation of downhole tubular members such as casing and lining as well as the installation of equipment required to produce fluids from, or inject fluids into, the subterranean well.

In the example embodiments of FIGS. 1-3, subterranean well 10 includes surface casing 14, intermediate casing 16, and production casing 18. Submersible pump system 20 is shown lowered on a tubular member 22, such as coiled tubing or tubing joints. Packer 24 seals an annular space between an outer diameter of tubular member 22 and an inner diameter of production casing 18. In alternate embodiments, submersible pump system 20 could be lowered by cable. Submersible pump system 20 can include pump section 26 that provides lift to the wellbore fluids. Pump section 26 can be a multistage centrifugal pump with stacked stages of impellers and diffusers.

An intake can direct wellbore fluids into the pump section 26. Depending on the configuration of the well completion, the wellbore fluids can pass out of a discharge of submersible pump system 20 into tubular member 22 or into production casing 18 for delivery to the surface. Submersible pump system 20 can, in certain embodiments, also include motor 28 and protector 30 that is located between pump section 26 and motor 28 (FIGS. 1-2). Protector 30 can be used for equalizing pressure within submersible pump system 20 with that of the wellbore, for providing a seal, for containing an oil reservoir for motor 28, and for helping to convey the thrust load of pump section 26. Motor 28 can be used in certain embodiments for driving or rotating pump section 26. In alternate embodiments as described herein, submersible pump system 20 does not have a motor.

The disclosed methods and systems for lifting wellbore fluids in subterranean well 10 includes closed fluid system 32. Closed fluid system 32 can be a closed water system that utilizes water in a liquid form and in a gas form as steam. In certain embodiments, closed fluid system 32 utilizes demineralized water. Demineralized water provides an approximate 1:1 water/steam ratio, is inexpensive and easy to find, is easy and safe to work with, and has no minerals or other elements that would have to be handled. In alternate embodiments, closed fluid system 32 can utilize an alternate fluid in both liquid and gas form that can operate within the temperature, pressure and energy requirements of the system of the embodiments of this disclosure. As used herein, the term "closed fluid" refers to the fluid used in closed fluid system 32 regardless of the type or state of such fluid.

Closed fluid system 32 is completely separated from the wellbore fluids so that the closed fluid of closed fluid system 32 is free of fluid communication with the wellbore fluids.

In this way, the closed fluid of the closed fluid system 32 cannot mingle with the wellbore fluids. Closed fluid system 32 includes fluid storage tank 34 located outside of a high temperature zone of subterranean well 10. In the example embodiment of FIGS. 2-3, fluid storage tank 34 is located at surface 12. Surface pump 36 can be used to pump closed fluid of closed fluid system 32 into subterranean well 10.

In the alternate example of FIG. 1, fluid storage tank 34 is located within subterranean well 10. In such an embodiment, closed fluid system 32 can be located entirely within subterranean well 10. Fluid storage tank 34 can be installed in the annulus between the outer diameter of tubular member 22 and the inner diameter of production casing 18. The distance fluid storage tank 34 is placed from surface 12 is determined by the location of high temperature zone 40. Fluid delivery line 37 extends from fluid storage tank 34 to turbine 38 to deliver water from fluid storage tank 34 to turbine 38. When water and steam is used as the closed fluid, turbine 38 can include one or more traditional steam turbines. Gravity can cause the closed fluid to travel from fluid storage tank 34 to turbine 38 and the energy generated when the closed fluid is transferred a steam can lift the steam back to fluid storage tank 34 after the close fluid has passed through turbine 38.

As the closed fluid in the form of a liquid, such as water, is circulated from fluid storage tank 34 towards turbine 38 the closed fluid passes through high temperature zone 40 of subterranean well 10 to form a gas such as steam. In the example embodiment of FIGS. 1-2, high temperature zone 40 is shown as a region proximate to submersible pump system 20. Submersible pump system 20 can generate high temperatures due to the load on motor 28. The high temperature generated by submersible pump system 20 within the region surrounding submersible pump system 20 can exceed 212 F, which is the boiling point of water, to form high temperature zone 40. As the closed fluid passes through high temperature zone 40 the closed fluid is heated by the high temperature generated by submersible pump system 20 to evaporate and form a gas such as steam. In embodiments where the closed fluid is a fluid other than water, the high temperature generated by submersible pump system 20 within high temperature zone 40 can exceed the temperature required to convert such closed fluid to a gas.

In the example embodiment of FIG. 3, high temperature zone 40 is located at a depth below surface 12 as a result of geothermal heat. In locations, geothermal energy can heat regions of subterranean well 10 to form high temperature zone 40 that can have a temperature in excess of 212 F. In embodiments where the closed fluid is a fluid other than water, the high temperature generated by geothermal energy within high temperature zone 40 can exceed the temperature required to convert such closed fluid to a gas. As the closed fluid passes through high temperature zone 40 the closed fluid is heated by the geothermal energy to evaporate and form a gas such as steam. Although not shown, geothermal energy can be used to form high temperature zone 40 in embodiments with fluid storage tank 34 located within subterranean well 10 outside of the high temperature zone 40.

The closed fluid in the form of a gas rotates turbine 38. Turbine 38 can drive submersible pump system 20 which is in fluid communication with the wellbore fluids and can then lift the wellbore fluids towards surface 12. Although turbine 38 is shown schematically at a lower end of tubular member 22, turbine 38 is not in fluid communication with wellbore fluids. It is the fluid of closed fluid system 32 only that rotate turbine 38. The wellbore fluid instead enters the intake of submersible pump system 20 which is separate from, and not in fluid communication with, turbine 38.

Looking at FIGS. 1-3, an intermediate member 42 is located between turbine 38 and submersible pump system 20. In the example of FIGS. 1-2, intermediate member 42 can be a power assembly. The power assembly can act as both an electric generator and an electric receiver. The power assembly can provide electric power to motor 28 of submersible pump system 20 to operate submersible pump system 20.

In embodiments where the high temperature generated by submersible pump system 20 within the region surrounding submersible pump system 20 forms high temperature zone 40, the power assembly can receive electric power by way of source electrical cable 44 (FIG. 2) for initiating operation of submersible pump system 20. After submersible pump system 20 has been operating for some time and reaches sufficient temperature that high temperature zone 40 can turn the closed fluid to steam, turbine 38, which is rotated by the steam, can the drive power assembly so that the power assembly operates as an electric generator to generate electricity to power submersible pump system 20. Therefore after the initial startup of submersible pump system 20, no further electric power from the surface is required for the continued operation of submersible pump system 20. While turbine 38 is operating the power assembly to generate electricity, any electric power in excess of what is needed to operate submersible pump system 20 can be delivered to the surface through excess electrical cable 46 (FIG. 2) to a power receiver outside of subterranean well 10. The power receiver can be, for example, a power storage device or other tools or equipment used for the development of hydrocarbons.

In alternate embodiments, such as the example embodiment of FIG. 3 where geothermal energy can heat regions of subterranean well 10 to form high temperature zone 40, no electrical communication between the surface and systems for lifting wellbore fluids in subterranean well 10 is required. Submersible pump system can be operated completely by turbine 38 transferring mechanical rotation of turbine 38 to shaft 48 of submersible pump system 20. In such an embodiment, intermediate member 42 can be a gear assembly so that the rate of rotation of shaft 48 of submersible pump system 20 can be varied relative to the rate of rotation of turbine 38.

After exiting turbine 38, the closed fluid can be directed back to fluid storage tank 34 by way of fluid return line 52. As the closed fluid returns to fluid storage tank 34, the closed fluid exits high temperature zone 40 and can cool to return to the fluid storage tank as a liquid or as a combination of liquid and gas. Temperature control valves 50 can be located between fluid storage tank 34 and turbine 38 and can be used to control the amount of vapor and water going into and out of turbine 38. Even with the temperature control valves 50, all of the steam in the system is used continuously which is more efficient than using steam partially or selectively.

In an example of operation, subterranean well 10 is completed in a traditional manner with submersible pump system 20 and closed fluid system 32 being lowered into subterranean well 10 as part of the well completion. Fluid from fluid storage tank 34 is circulated into high temperature zone 40 of subterranean well 10 to form a gas. The gas is used to rotate downhole turbine 38 with the gas to drive submersible pump system 20. Submersible pump system 20 is in fluid communication with the wellbore fluids and lifts the wellbore fluids towards surface 12 to produce the wellbore fluids. The closed fluid exiting from turbine 38 is directed back towards fluid storage tank 34. In certain embodiments, external electrical power can be used only when starting submersible pump system 20 but is not used during the continuous operation of submersible pump system 20.

Embodiments of this disclosure therefore provide systems and methods for lifting fluids within a wellbore with submersible pump systems that are more reliable and less costly to operate than some current methods and systems. Many of the failures of current electrical submersible pumps are due to short circuit and failures of the cables from the surface to the downhole location where the pump is set. Systems and methods described herein will reduce or eliminate such failures. In addition, current electrical submersible pumps consume large amounts of electrical energy for continuous operation. Systems and methods described herein will reduce operating costs associated with lifting wellbore fluids because embodiments of this disclosure do not require a continuous external electrical power supply. Certain embodiments described herein only require an external electrical power supply for initiating operation of submersible pump system 20.

Embodiments described herein, therefore, are well adapted to carry out the objects and attain the ends and advantages mentioned, as well as others inherent therein. While certain embodiments have been described for purposes of disclosure, numerous changes exist in the details of procedures for accomplishing the desired results. These and other similar modifications will readily suggest themselves to those skilled in the art, and are intended to be encompassed within the scope of the present disclosure disclosed herein and the scope of the appended claims.

What is claimed is:

1. A method of lifting wellbore fluids in a subterranean well towards a surface, the method including:

providing a closed water system free of fluid communication with the wellbore fluids, the closed water system being located entirely within the subterranean well and having a water storage tank that is located outside of a high temperature zone of the subterranean well;

circulating water from the water storage tank into the high temperature zone of the subterranean well to form a steam;

rotating a downhole steam turbine with the steam to drive a submersible pump system in fluid communication with the wellbore fluids and lifting the wellbore fluids towards the surface with the submersible pump system; and directing the steam exiting from the steam turbine towards the water storage tank; where a high temperature of the high temperature zone is generated by the submersible pump system.

2. The method of claim 1, wherein the steam turbine transfers mechanical rotation of the steam turbine to a shaft of the submersible pump system.

3. The method of claim 2, further including a gear assembly located between the steam turbine and the submersible pump system so that a rate of rotation of the shaft of the submersible pump system can be varied relative to a rate of rotation of the steam turbine.

4. The method of claim 1, further including a power assembly having an electric generator, wherein the steam turbine drives the electric generator to power the submersible pump system.

5. The method of claim 4, where the power assembly is located between the steam turbine and the submersible pump system, the power assembly receiving power by way of an electrical cable for initiating operation of the submersible pump system.

6. A method of lifting wellbore fluids in a subterranean well towards a surface, the method including:

lowering a submersible pump system into the subterranean well as part of a well completion;

circulating a closed fluid through a closed fluid system that is free of communication with the wellbore fluids wherein:

the closed fluid is a liquid and a portion of the closed fluid is located within a fluid storage tank located outside of a high temperature zone of the subterranean well;

the closed fluid is heated to a gas within the high temperature zone of the subterranean well, where a high temperature of the high temperature zone is generated by the heat of the submersible pump system;

the gas is used to rotate a turbine that drives the submersible pump system to lift the wellbore fluids towards the surface;

the closed fluid returns to the fluid storage tank; and circulating the closed fluid includes circulating the closed fluid through the closed fluid system entirely within the subterranean well.

7. The method of claim 6, further including controlling a flow of the gas into the turbine with temperature control valves.

8. The method of claim 6, further including delivering excess electrical power generated by the turbine to a power receiver outside of the subterranean well.

9. The method of claim 6, wherein the closed fluid returns to the fluid storage tank as the liquid, the closed fluid cooling as the closed fluid exits the high temperature zone of the subterranean well.

10. A system for lifting wellbore fluids in a subterranean well towards a surface, the system including:

a closed water system that is free of fluid communication with the wellbore fluids, the closed water system being located entirely within the subterranean well and having a water storage tank that is located outside of a high temperature zone of the subterranean well;

the closed water system including a circulating system extending from the water storage tank into the high temperature zone of the subterranean well, the circulating system operable to absorb sufficient heat from the high temperature zone to convert water of the closed water system to steam;

a downhole steam turbine rotatable by the steam to drive a submersible pump system in fluid communication with the wellbore fluids and lift the wellbore fluids towards the surface with the submersible pump system, where the submersible pump system is operable to heat the high temperature zone to a high temperature; and the circulating system extending from the steam turbine towards the water storage tank.

11. The system of claim 10, wherein the steam turbine is operable to transfer mechanical rotation of the steam turbine to a shaft of the submersible pump system.

12. The system of claim 11, further including a gear assembly located between the steam turbine and the submersible pump system, the gear assembly operable to vary a rate of rotation of the shaft of the submersible pump system relative to a rate of rotation of the steam turbine.

13. The system of claim 10, further including a power assembly having an electric generator operable to be driven by the steam turbine and power the submersible pump system.

14. The system of claim 13, where the power assembly is located between the steam turbine and the submersible pump system, the power assembly operable to receive power by way of an electrical cable for initiating operation of the submersible pump system.

* * * * *